US005640911A

United States Patent [19]

Peters

[11] Patent Number: 5,640,911

[45] Date of Patent: Jun. 24, 1997

[54] WATER AND SAND TABLE

[76] Inventor: William H. Peters, Box 184, West Unity, Ohio 43570

[21] Appl. No.: 305,070

[22] Filed: Sep. 14, 1994

[51] Int. Cl.[6] ..... A47B 77/06

[52] U.S. Cl. ..... 108/26; 312/228; 248/146

[58] Field of Search ..... 108/24, 25, 26, 108/26.2, 182; 312/228, 229, 232; 248/150, 146, 149

[56] References Cited

U.S. PATENT DOCUMENTS

| | | | |
|---|---|---|---|
| 49,821 | 9/1865 | Ziegler | 108/25 X |
| 451,346 | 4/1891 | Tweeddale | 312/228 X |
| 556,157 | 3/1896 | Minor | 248/146 X |
| 1,201,903 | 10/1916 | Wiley | 108/129 X |
| 1,338,034 | 4/1920 | Nickels | 108/25 X |
| 1,474,872 | 11/1923 | Witt | 248/146 |
| 2,022,591 | 11/1935 | Everitt | 312/228 X |
| 2,254,939 | 9/1941 | Ellas | 248/150 |
| 3,162,495 | 12/1964 | Swift | 108/25 X |

FOREIGN PATENT DOCUMENTS

| | | | |
|---|---|---|---|
| 2627963 | 9/1989 | France | 108/26 |
| 658077 | 3/1938 | Germany | 108/26 |
| 2426720 | 12/1975 | Germany | 312/228 |
| 356786 | 10/1961 | Switzerland | 312/228 |

*Primary Examiner*—Peter M. Cuomo
*Assistant Examiner*—Janet M. Wilkens

[57] ABSTRACT

The subject apparatus is an improved sand and water table, as used by young children for play and educational purposes, such sand and water table comprising a supported table having a depressed container area, which is open at the top for access from above with an upper perimeter around the upper edge of the depressed container area, in which perimeter is formed a recessed channel area that functions for dual purposes, one being to help prevent spillage of sand, water, or other products from the depressed container area, and the other function being to receive conformingly the bottom perimeter of a covering lid.

6 Claims, 3 Drawing Sheets

WATER AND SAND TABLE

DISCUSSION OF PRIOR ART AND BACKGROUND OF INVENTION

The subject apparatus is directed to items that are used to help educate young children, particularly pre-school children, in learning activities. Many of these educational items are adapted and structured to permit young children to use their hands in combined play and work activities.

One such apparatus used in the educational development of young children is the sand and water table that features a tub-like member in which water and sand are placed to allow children to manipulate and work with the dampened sand. Usually, these tub-like members are supported on an upright table with the open tub being on the upper portion of the table so that the depressed area of the tub-like member is accessible for use while the child stands or is seated. These sand and water tables vary in size, structure, shape and design. However, one of the common problems encountered with the usage of such tables is that they are not structured to help alleviate the problem of sand and water falling up and over the side edges of the table when used by the young children. This particular problem is addressed by this invention, as seen in the following objects.

Yet another problem that prevails with existing water table structures is that the upper portions of such tables are generally not structured to receive a conforming lid that effectively covers, secures, and seals the table when the table is not being used. Most existing water and sand tables are not structured so as to effectively be covered with a corresponding lid member that seals the tub portion holding the water and sand. The subject invention is further structured so as to provide a table top edge that is adapted to receive conformingly a lid member that properly seals the tub contents.

The objects set forth below reflect these aspects.

OBJECTS OF INVENTION

The following are objects of the subject invention:

It is an object of the subject apparatus to provide an improved water and sand table;

It is also an object of the subject invention to provide a water and sand table that possesses features to minimize the overflow of sand and water over the table edges;

Yet another object of the subject invention is to provide an improved perimeter edge for a sand and water table;

Still another object of the subject invention is to provide an improved water table structure to accommodate an accommodating secure lid structure;

A further object of the subject invention is to provide an improved perimeter edge structure for a tub member;

Yet another object of the subject invention is to provide an improved structure to seal a sand and water tub;

Other and further objects of the subject invention can be seen in the following description and claims read in view of the dregs,

IN THE DRAWINGS

DESCRIPTION OF GENERAL EMBODIMENT

Figure 1:
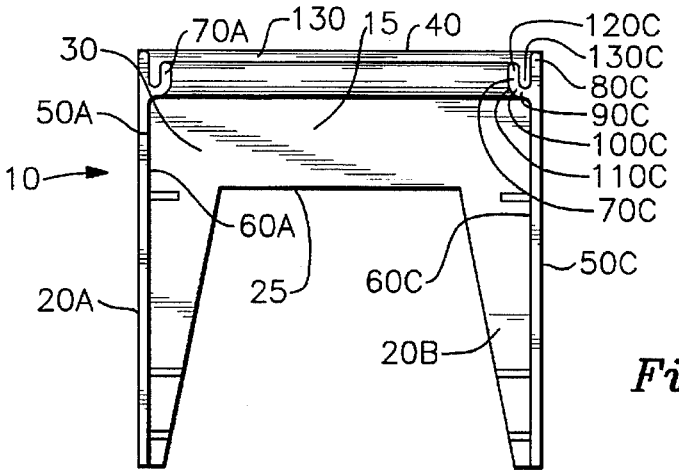
FIG. 1 is an end elevational view of the subject invention, in section.
Figure 2:
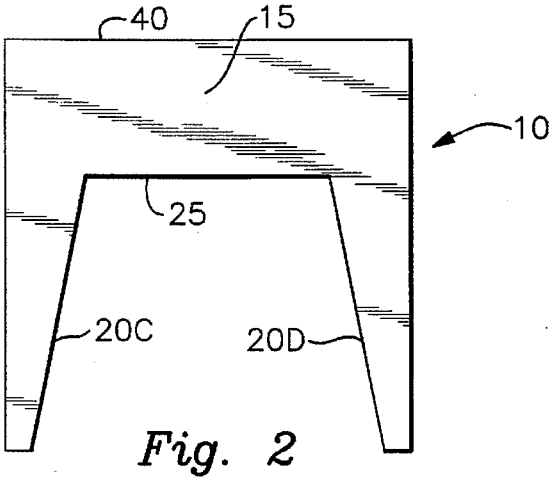
FIG. 2 is an end elevational view of the subject invention.
Figure 3:
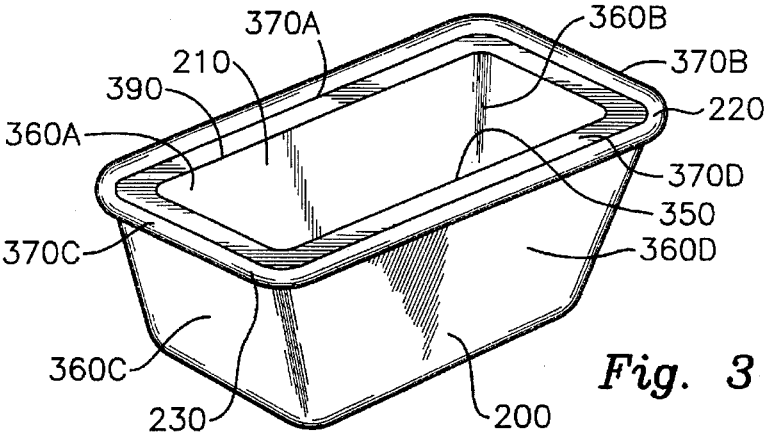
FIG. 3 is a perspective view of a basin insert.
Figure 5:
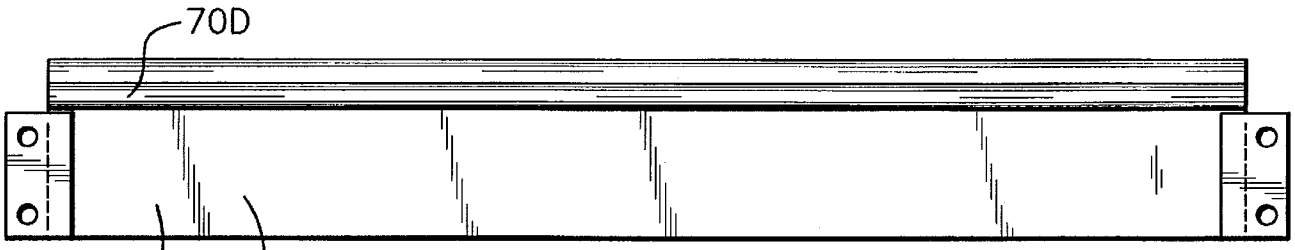
FIG. 5 is an end side elevational view from the inside of a side member of the base top member.
Figure 6:
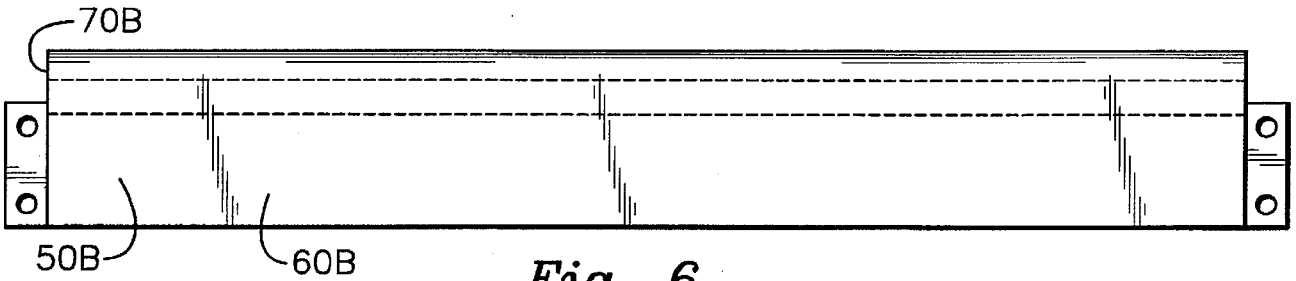
FIG. 6 is a side elevational view of a side member of the base top member from an outside view.
Figure 7:
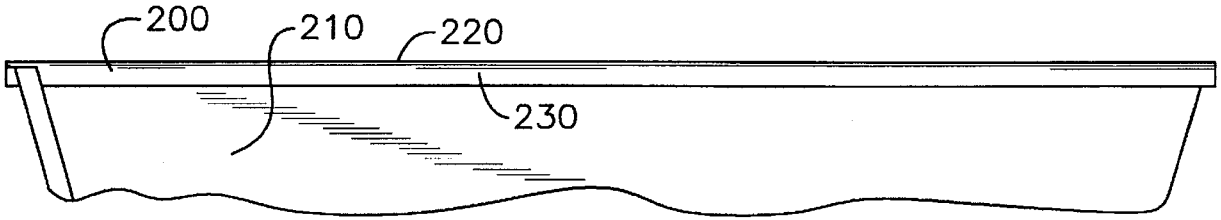
FIG. 7 is a side view in section of the insert member.
Figure 4:
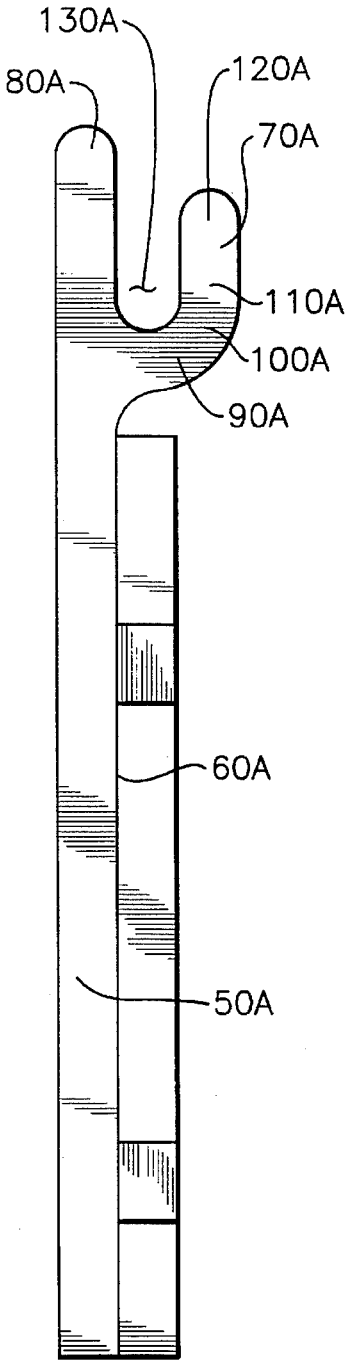
FIG. 4 is a side elevational view of a side member of the base top member.
Figure 8:
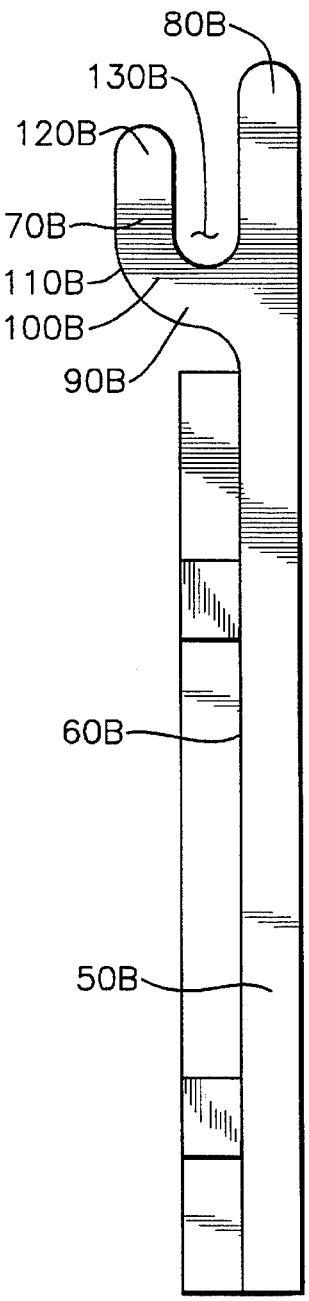
FIG. 8 is a side elevational view of the side member.
Figure 9:
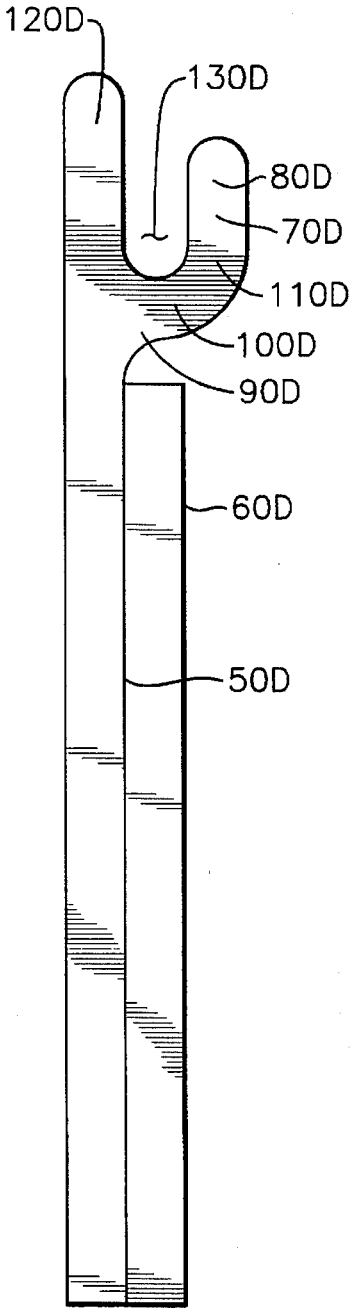
FIG. 9 is a side elevational view of the second side member.

The subject apparatus is an improved sand and water table, as used by young children for play and educational purposes, such sand and water table comprising a supported table having a depressed container area, which is open at the top for access from above, with an upper perimeter around the upper edge of the depressed container area, in which perimeter is formed a recessed channel area that functions for dual purposes, one being to help prevent spillage of sand, water, or other products from the depressed container area.

In the most general embodiment of the subject invention, the invention comprises a base member having a basin formed therein, such basin having a solid bottom surface with upwardly protruding perimeter walls forming with such bottom surface an open basin into which basin can be placed various substances such as sand, water, or other materials, which materials can be manually manipulated for play purposes. The uppermost extent of the walls form an upper perimeter surface edge which is generally horizontal when the member is placed in position for usage. The focus of the invention herein is a depressed ridge or channel formed into the upper perimeter surface edge in such a manner that the channel extends in a perimeter-like manner all the way around the upper perimeter surface edge of the base member. Stated alternately, the base member has formed in its uppermost surface a recessed channel that descends downwardly into the base member from the upper surface edge, such channel either extending all the way around the upper surface edge in a perimeter-like manner or alternately, extending only a partial distance around the upper perimeter edge. This recessed channel, as stated, functions a dual purpose to help keep substances in the basin from falling over the top edges and additionally serves as a recessed portion into which the conformingly-shaped bottom perimeter edge of a covering lid can be placed to securely hold the covering lid in place.

DESCRIPTION OF PREFERRED EMBODIMENT

The following description is of a preferred embodiment of the subject invention, and such description of a preferred embodiment is not to be construed as limiting the scope of the subject invention, as set forth in the annexed claims. Thus, the fact that one embodiment is described in the following description does not preclude the inclusion of other embodiments within the scope of the claims. Moreover, while the subject invention is focused and centered on a table member, the invention can be structured and deployed other than as a table member.

Referring now to the drawings in which a preferred embodiment of the subject invention is shown, a table member 10 is shown as being structured with an upright base member 15, with multiple vertical leg members 20A, 20B, 20C and 20D, depending from the bottom surface 25 of the base member 15.

Base member 15 as structured in the preferred embodiment is tantamount to a table top. It is to be noted that the fact that the invention described herein is set forth as a table member with vertically disposed supporting legs does not alter the aspect that the subject invention need not be formulated, structured, or incorporated in a table as such, as the subject invention need not be focused on a table member, but can be incorporated in a structured member that is not a table structure having legs. In short, the invention herein can be incorporated in most any type of structure having a recessed, open basin that can be filled with sand, water or other substances, as more fully described below.

Moreover, it is to be stressed that by describing the table 10, with top base member 15 having four supports, with legs 20A, 20B, 20C and 20D, with a rectangularly-shaped top member 15 as described and shown, with top base member 15 and supporting legs 20A, 20B, 20C and 20D does not preclude base member from having other shapes and supporting means. These variations may include, among other variations, other than employing such vertical support legs 20A, 20B, 20C and 20D for support purposes, and may have any number of legs or none at all, and yet still fall within the scope of the subject invention.

Attention is again directed to the drawings which, as stated, show table 10 with top base member 15 having four affixed supporting legs 20A, 20B, 20C and 20D affixed to the bottom surface 25 of top base number 15. Top base members is formed, in the preferred embodiment, as having a hollow interior spatial area 30 that is open at the top forming thereby an upper opening 40 exposed from above the top base member 15. In the preferred embodiment, the interior spatial area 30 in the base top base member 15 is simply and solely formed by vertical side walls 50A, 50B, 50C and 50D, with no solid bottom surface and no upper surface. Alternately stated, in the preferred embodiment of the subject invention, the upper base top base member is basically formed and comprised solely by four vertical walls 50A, 50B, 50C and 50D joined together on their respective end edges in a box-like manner and rectangular fashion, with the supporting legs 20A, 20B, 20C and 20D depending downwardly in a vertical manner from the corner joints when respectively adjoining side edges of sides 50A, 50B, 50C and 50D are joined. Thus, in the preferred embodiment the top base member 15 is formed as an empty shell formed solely of vertical, slab-like sides with no bottom or top surfaces, and an open area 30 in between the respective inner surfaces 60A, 60B, 60C and 60D of vertical sides 50A, 50B, 50C and 50D respectively.

As can be further seen in the drawings, integrally formed on the upper portions of the inner surfaces 60A, 60B, 60C and 60D of the vertical sides 50A, 50B, 50C and 50D are longitudinally extending ledges 70A, 70B, 70C and 70D respectively, with each such ledge extending along the entire longitudinal portion of each vertical side, at the same distance below the uppermost edges 80A, 80B, 80D and 80D of each vertical side 50A, 50B, 50C and 50D. As can be seen in the drawings, particularly the end elevational views, the longitudinal ledges 70A, 70B, 70C and 70Dare shaped with an inwardly extending and longitudinally structured bottom base portions 90A, 90B, 90C and 90D, such base portion on each ledge extending generally in a perpendicular direction away from the vertical inner surfaces 60A, 60B, 60C and 60D of each such vertical side 50A, 50B, 50C and 50D. Integrally affixed to the distal edges 100A, 100B, 100C and 100D, that is the edges most distal from the conjoined vertical side, 50A, 50B, 50C or 50D of the bottom base portions 90A, 90B, 90C and 90D are longitudinally extending, partially upright, arm members 110A, 110B, 110C and 110D. The latter longitudinally extending arm members 110A, 110B, 110C and 110D are thus joined on their lower ends to the distal edges of 100A, 100B, 100D and 100D of the bottom base portions 90A, 90B, 90C and 90D of the ledges 70A, 70B, 70C and 70D, with the upper edges 120A, 120B, 120C and 120D of such longitudinally extending upright arms 110A, 110B, 110C and 110D projecting upwardly. As seen in the drawings, an interior, longitudinally extending channel 130A, 130B, 130C and 130D is formed within each ledge 70A, 70B, 20C and 70D by the upright arm 110A, 110B, 110C and 110D and the upper part of the bottom base portion and the juxtaposed inner surface 60A, 60B, 60C and 60D of each vertical side 50A, 50B, 50C and 50D. By this structural relationship, the longitudinally extending channels 130A, 130B, 130C and 130D are recessed with the opening to each such channel being formed respectively by the upper portions of ledges 70A,, 70B, 70C and 70D and the upper portions of vertical sides 50A, 50B, 50C and 50D such that the respective channels 130A, 130B, 130C and 130D depend downwardly from each such opening.

Further, as can be seen in the drawings, in the preferred embodiment of the subject invention, the upper edges 80A, 80B, 80C and 80D of the vertical sides 50A, 50B, 50C and 50D extend slightly higher than the upper edges 120A,120B, 120C and 120D of the upright arms 110A, 110B, 110C and 110D. By this latter relationship, the longitudinally extending channels 130A, 130B, 130C and 130D thus have a greater depth on the portion closest to the adjoining side 50A,50B, 50C and 50D, as seen in the drawings.

When all the vertical sides of 50A, 50B, 50C and 50D of top base member 15 are joined together, each ledge member 70A, 70B, 70C and 70D, preferably with beveled ends, are joined together to form a continuous ledge member on the inside surfaces of the base top member 15 such that the respective channels 130A, 130B, 130C and 130D become unified as one continuous perimeter channel member 130 on such inside surface.

In the preferred embodiment of the subject invention, a rectangular tray member 200 having a recessed basin 210 and having an upper perimeter edge 220 is adapted to be placed over the top of the conjoined ledge members 70A, 70B, 70C and 70D. More particularly, the rectangular tray member 200 is formed with an upper perimeter edge 220 that has a downturned rimmed portion 230 that extends over the edge 220 of the tray. This edge 220 and downturned portion 230 of the tray are shaped and sized to fit conformingly over the outer arms 110A, 110, 110C and 110D of the ledges 70A, 70B, 770E and 70D so that the tray 200 is supported over such arms with the downwardly turned portions of such tray 200 being slightly higher than the upper edges 120A, 120B, 120C and 120D of the upright arms 110A, 110B, 110C and 110D. By this latter relationship, the longitudinally extending channels 130A, 130B, 130C and 130D and thus the unified channel 130 has a greater depth on the portion closest to the adjoining side 50A, 50B, 50C and 50D, as seen in the drawings.

When all the sides 50A, 50B, 50C and 50D of top base member 15 are joined together, each ledge member 70A, 70B, 70C and 70D, preferably with beveled ends,are joined together to form a continuous ledge member on the respectively adjoining inside surfaces of the top base member partially inserted into the unified perimeter channel 130 extending around on the unified ledge 80. In the preferred embodiment, the downwardly turned edge of tray 200 does not fill the entire width of the unified channel 130.

The tray member 200, as stated, is formed with a recessed basin 210 that is open at the top. The basin 210 is the area in which sand, water and other substances can be placed for work or play purposes. The tray member 200 can be removed by lifting it off the unified ledge 80 for cleaning or other purposes.

Moreover, a lid member, not shown, maybe provided for covering the basin 210 when not used. This lid member would have a bottom edge shape that would conform to the size, structure, and shape of the unified ledge and unified channel 130 so that the lid fits conformingly into a part of the unified perimeter channel 130 just inside the inside surfaces 60A, 60B, 60C and 60D of the side walls 50A, 50B, 50C and 50D.

The recessed basin 210 in tray 200 is formed by a bottom surface 350, which is flanked by four vertical side walls 360A, 360B, 360C and 360D. The vertical side walls each have an upper edge surface 370A, 370B, 370C and 370D, and since these vertical side walls are all joined together at their respective vertical side edges, they form a continuous and solid vertical side wall protection that basically and generally forms the vertical part of the recessed basin 210 in tray 200, and since these side walls are contiguous on the bottom edges with the horizontal side edges of the bottom surface 350 of the basin 210, the recessed basin is effectively an enclosed member having continuous, solid surfaces enclosing the basin 210, except for an opening 390 on the upper part of the basin that exposes the basin to the outside and provides access from above to the basin for a person to work with the contents of the basin.

In summary, the basic structure of the container member is thus that of an open bin or basin, that is open at the top having upwardly extending perimeter edges that provide the perimeter boundaries of the container for purposes of containing the sand, water, etc within the confines of the open bin. As can be seen, the outer perimeter of the bin-like container is formed by opposing side walls. As further can be seen are the upper edges or upper surfaces of the side walls that have some minimal thickness and width into which a recessed channel is formed. In further summary, the subject invention is a water table for functional use comprising a table member having supporting legs, such table member having an upper platform with container means disposed in the upper surface of such table member. In further summary, the subject invention is a functional member having a depressed basin in a portion of such member, such depressed basin being open at the top and adapted to hold substances to be manually manipulated, such functional member having an upper surface surrounding a portion of such depressed basin, which such upper surface having an outer perimeter edge, with such upper surface having on a portion thereof a vertically upwardly protruding ledge that extends upwardly beyond the uppermost portion of such upper surface.

I claim:

1. A water table for functional use comprising:

(a) meter surface, with the upper perimeter surface of said platform having a depressed channel around said upper perimeter surface and wherein said channel is formed with an upwardly extending inner arm and an upwardly extending outer arm, said outer arm extending higher above the upper perimeter surface of the upper platform of the table member than said upper extending inner arm;

(b) container means disposed in the upper surface of said upper platform of said table member.

2. An apparatus with a surface portion with a top portion including a depressed basin in the top portion of said apparatus, said depressed basin being open at the top and adapted to hold substances, said apparatus having an upper surface surrounding said depressed basin, said upper surface having an outer perimeter edge, said upper surface having a recessed channel extending along said perimeter edge, said channel being formed by an outer vertical arm member and an inner vertical arm member, both said vertical arm members being integrally connected to said apparatus, said outer vertical arm member extending higher in its uppermost extent above said upper surface of said apparatus relative to the inner vertical arm member.

3. A member for functional use comprising:

(a) a table assembly having an open basin in an upper surface of said table assembly, said basin having an upper perimeter edge, said upper perimeter edge having a recessed channel formed along the entire length of said upper perimeter edge; and (b) said channel being formed of an arm member affixed to said table assembly providing the outer periphery of the recessed channel, said arm member extending upwardly to a vertical extent to a level higher than any other portion of said table assembly.

4. A table assembly having a top portion and a bottom, said assembly including a depressed basin in said top portion, said depressed basin having an opening located at the top and adapted to hold substances to be manually manipulated, there-in, said table assembly having an upper perimeter surface surrounding said depressed basin, which upper perimeter surface having a downwardly extending channel formed along the entire perimeter of said upper perimeter surface, and wherein the channel is formed of two opposing upper portions wherein the upper portion of such channel most distant from the depressed basin extends vertically upwardly higher than all other portions of said table assembly.

5. A table assembly with a table top comprising:

(a) an upper portion and a lower portion, said table top having support members for holding the table top of said table assembly, said table top having an upper surface, said table rod having an outer perimeter edge with an upwardly extending ridge member over said upper surface of said table top, said ridge member being on said outer perimeter edge and extending completely about said perimeter edge, said ridge member extending upwardly above said table top;

(b) recessed basin means extending downwardly from said table top, said recessed basin means having an upper opening, the upper perimeter of said opening being contiguous with the upper surface of said table top; and (c) a channel extending downwardly into said table top with the upper portion of said channel being formed of said upwardly extending ridge.

6. An upright table assembly including a depressed basin, said depressed basin being open at the top and adapted to hold substances, said table assembly having an upper surface surrounding said depressed basin, said upper surface having an outer perimeter edge about said basin, said upper surface having a depressed channel extending completely around said basin with said depressed channel being formed in part by an upright inner arm and an upright outer arm disposed on opposite sides of said channel, said upright outer arm extending higher above said upper surface than said inner arm.

* * * * *